US005943720A

United States Patent [19]

Chung

[11] Patent Number: 5,943,720

[45] **Date of Patent: *Aug. 31, 1999**

[54] ZERO EMISSION DRY CLEANING MACHINE AND PROCESS

[76] Inventor: Jong Wha Chung, 50-66 Horatio Parkway, Bayside, N.Y. 11364

[ * ] Notice: This patent issued on a continued prosecution application filed under 37 CFR 1.53(d), and is subject to the twenty year patent term provisions of 35 U.S.C. 154(a)(2).

[21] Appl. No.: 08/924,472

[22] Filed: Aug. 19, 1997

Related U.S. Application Data

[63] Continuation of application No. 08/619,302, Mar. 21, 1996, abandoned.

[51] Int. Cl.[6] ..... D06F 43/08

[52] U.S. Cl. ..... 8/158; 68/18 C; 68/20; 68/27

[58] Field of Search ..... 68/18 R, 18 C, 68/20, 27; 8/158

[56] References Cited

U.S. PATENT DOCUMENTS

| | | | |
|---|---|---|---|
| 3,177,126 | 4/1965 | Charreau | 68/18 C X |
| 3,236,073 | 2/1966 | Davison et al. | 68/18 C X |
| 3,426,555 | 2/1969 | McCutcheon | 68/18 C X |
| 3,600,911 | 8/1971 | McLagan | 68/18 C |
| 3,676,307 | 7/1972 | Black | 68/18 C X |
| 3,977,218 | 8/1976 | Zucchini | 68/18 C X |
| 4,520,577 | 6/1985 | Suissa | 68/18 C X |
| 4,879,888 | 11/1989 | Suissa | 68/18 C |

FOREIGN PATENT DOCUMENTS

| | | | |
|---|---|---|---|
| 227799 | 9/1989 | Japan | 68/18 R |

*Primary Examiner*—Philip R. Coe
*Attorney, Agent, or Firm*—Ward & Olivo

[57] ABSTRACT

An improved dry cleaning machine and process which eliminates solvent emissions while simultaneously providing cost and quality benefits. The solvent filtration apparatus and process currently used in typical dry cleaning operations is eliminated and the solvent is instead separated based on the anticipated extent of contamination wherein the less clean solvent is cleaned via a distillation unit.

21 Claims, 5 Drawing Sheets

ZERO EMISSION DRY CLEANING MACHINE AND PROCESS

This is a continuation of application Ser. No. 08/619,302, filed Mar. 21, 1996, now abandoned.

FIELD OF THE INVENTION

The present invention is an improved dry cleaning machine and process that eliminates perchloroethylene ("perc") or other solvent emission while simultaneously providing cleaner clothing than other dry cleaning machine presently available. More specifically, the present invention provides a design and process that circumvents the need for the filtration step currently performed during conventional dry cleaning processes. Present filtering techniques are at best marginally effective—at worst they provide a primary source of environmentally harmful perc emissions. By eliminating the need for filtration, the present invention yields significant environmental, cost and quality benefits. In an alternative embodiment, individual tanks for lighter and darker fabrics may be used to increase load capacities and efficiency.

BACKGROUND OF THE INVENTION

Dry cleaning establishments are commonplace the world over and have, for many years, provided valuable services in cleaning, sanitizing and restoring fabrics and clothing garments which are not suitable for laundering operations. While the specific machinery used in such dry cleaning operations varies somewhat, generally all utilize a closed drum having a rotatable tumbling basket disposed therein for receiving a quantity of clothing or the like for dry cleaning. The drum is usually equipped with an access door which is closed and preferably sealed during cleaning operations. The basic cleaning cycle involves the introduction of cleaning solvent into the drum and basket which is circulated through various filters as the tumbling basket is agitated or rotated to tumble the clothing articles through the solvent. At some point, usually under the control of a master timer, the solvent is extracted in a cycle which culminates in a high speed spin operation. Next, heated air is circulated through the basket and clothing articles in a drying cycle. Frequently, the air used in the drying cycle is heated before it passes through the clothing, then cooled to condense solvent out of the air and finally reheated prior to the next circulation through the drying clothing. Following the drying cycle, a reduction or cool down cycle is the final step in the dry cleaning process.

When first used, such dry cleaning operations were conducted without concern for the environment. Thus, in many early dry cleaning machines, the circulated air was simply vented to the atmosphere to carry away the solvent during the drying operation. However, recent environmental laws and regulations have imposed very strict constraints upon dry cleaning operations. In general, these regulations and laws have mandated the use of closed systems which do not permit the venting of solvent into the atmosphere. In addition, current environmental laws and regulations mandate more efficient solvent recovery throughout the entire dry cleaning operation in response to concerns over solvent emissions during loading and unloading as well as solvent residues remaining in clothing at the completion of the dry cleaning cycle.

The goal of many of the recently enacted laws and regulations is the reduction of solvent contaminants in both the environment at large and the dry cleaning establishment to prevent adverse effects to the health and well-being of workers in such establishments. These regulations are particularly difficult to meet in busy dry cleaning establishments which may utilize multiple dry cleaning machines and which store substantial quantities of recently cleaned clothing. Thus, measurements directed to total solvent emissions within the air at the cleaning facility essentially monitor the cumulative effect of many solvent emission sources.

While presently available dry cleaning systems meet current environmental and workplace safety regulations, they do so only if properly maintained and operated. In view of the clear trend of environmental laws and regulations as well as workplace safety laws toward stricter and more demanding requirements, it is clear that improved dry cleaning systems will soon be required. Thus, there is a continuing need in the art for environmentally sound dry cleaning systems. It would be an additional benefit if such systems provided cost and quality benefits as well.

SUMMARY OF THE INVENTION

As noted, in a typical dry cleaning plant clothes and other fabric articles are cleaned in machines using a dry cleaning solvent such as perc. After the solvent has been used for cleaning in currently available machines, it is filtered to remove dirt, lint and other contaminants. The filtered solvent is thereafter returned to the machine. Filtering is customarily effected by apparatus using filter cartridges through which the solvent is passed. After filter cartridges have been used for a period of time, they must be replaced. However, before being discarded, the used cartridges must be stripped of solvent remaining in them not only to conserve the solvent but further because environmental restrictions prohibit the disposal of filter cartridges containing solvent.

In addition to continuous filtering that is conducted in presently available machines, the solvent must be periodically distilled in order to remove impurities that are not removed by filtering. In the distillation process, the solvent is in effect boiled or vaporized. The solvent vapor—usually together with steam—is thereupon condensed and the water and solvent of the resulting condensate are separated from one another by gravity since the solvent is heavier than water.

A further problem that arises in dry cleaning plants is the control of vapor or fumes from the volatile solvent. After clothes or other articles have been dry cleaned, they are tumbled in a drying tumbler or reclaimer with hot air to remove most of the solvent from the garments. The air from the tumbler or reclaimer containing residual solvent vapor cannot be discharged into the atmosphere, not only because of pollution problems, but also because this would result in an unacceptable loss of solvent. It is therefore usually passed through an adsorber comprising a housing containing activated carbon pellets which adsorb the solvent. After the carbon pellets have become saturated with solvent, they are desorbed by passing steam through the adsorber to drive off solvent, the resulting vapor together with the steam being condensed in a condenser and the condensate being thereafter fed to a solvent-water separator.

There are presently separate pieces of apparatus for filtering the solvent, stripping filter cartridges, distilling the solvent and adsorbing the solvent vapor. The use of such apparatus obviously involves considerable purchase, installation and maintenance costs.

These and other shortcomings of currently available machinery are overcome by the machine and process of the present invention—which represents a dramatic departure from the manner in which dry cleaning operations are currently carried out. The entire process is simplified and improved through the elimination of the filtration step. This is environmentally sound as it eliminates solvent emissions—and without emissions the operator may significantly reduce his use of solvents. It is cost effective since it eliminates all costs associated with the filtration unit, including the original machinery, replacement filters and disposal charges. It also improves cleaning quality because, as a general rule, the solvent is actually cleaner if it is not passed through a filtering system.

This is a point that bears additional emphasis. It is generally presumed that the filters in current dry cleaning machines effectively remove dirt, contaminants, dyes, etc., from the circulating solvent. Actually, those of skill in the art are well aware that filters only work well during the first few weeks of use—even though filters are commonly replaced only every few months. This stands to reason since the filters obviously get dirtier and dirtier during the course of their useful lives. Eventually (i.e., after a few weeks), the filter is dirtier than the solvent it is supposed to clean because the solvent is frequently cleansed through evaporation (after each dry cleaning process) and distillation (at least once a week), while the filter is never cleaned.

As was previously mentioned, perchloroethylene ($Cl_2C{=}CCl_2$), commonly called "perc" in the dry cleaning industry, has been the solvent of choice for safely cleaning clothes made from non water treatable fabrics, e.g. silk, wool, etc. Changes need to be made, however, since the ATSDR (Agency for Toxic Substances and Disease Registry) of the U.S. Department of Health and Human Services suspects long term exposure to high concentrations of perc as a possible carcinogen. It has been a trend in the design of dry cleaning machines to minimize perc emission into the atmosphere. Obviously, this trend needs to be greatly expanded upon.

Originally, clothes wet with perc were manually transferred from the cleaner to the dryer. The evaporating perc during manual transfer from the cleaner to the dryer was the most serious source of perc emission. This setup is called "wet & dry" in dry cleaning parlance (See FIG. 1). Once the wet garment was placed in the dryer, perc evaporating in the dryer was captured and returned to the perc tank. "Dry & dry" machines were invented to eliminate perc emission during manual transfer in the wet & dry setup. The dry & dry machine combined the cleaner and dryer in a single unit (See FIG. 2). Like the wet & dry setup, the dry & dry machine captured the evaporating perc in the dryer and returned it to the perc tank. For the purpose of cleansing the perc solvent, in addition to the filtration unit already found in wet & dry setup, the dry & dry machine includes a distillation unit that cooks the content of the perc tank at a temperature higher than 121.1° C., the boiling point of perc. The clean distilled perc is returned to the perc tank and non hazardous distillation residue, mostly dirt, can be safely disposed. Such machines are well known in the art.

The only remaining source of perc emission in the current dry cleaning machine occurs during the changing and disposal of used filters. Filters, (see, for example, FIG. 6), are used in the filtration of perc going directly from the perc tank to the cleaner, see FIGS. 1 and 2. Used filters can only be removed from the filtration unit soaked in perc. The disposal of used filters according to government standards is still an environmentally damaging and expensive practice. The current practice of disposing perc related waste is either incineration or chemical and/or biological transformation. The fumes from the incinerator plant, located in low population density areas, are released into the air, or the byproducts of the transformations, only slightly less harmful than perc, is stored at government regulated dump sites. Neither alternative is desirable. Even if an environmentally safe disposal method can be discovered, perc emission cannot be prevented because it would still take place during transport of used filters from the dry cleaning machine to the disposal plant.

Perc, by nature, is a non-flammable liquid that evaporates with extreme ease. It is this ease of evaporation that dry cleaning gets its name, as opposed to "wet" cleaning using water. Unfortunately, this ease of evaporation is also what makes sealing perc related waste without perc emission that much more difficult. Even if government regulated steps are followed in sealing used filters for disposal company pick up, there is a discrepancy in weight from the time the filters are sealed until the time they are picked up. The sealed used filters are picked up within the same day as the removal. The weight discrepancy can only be accounted for by the perc that evaporated into the air. It would be far more desirable to eliminate the filters entirely to circumvent the aforementioned difficulties.

The dry cleaning machine and process of the present invention accomplishes this, i.e., the elimination of the filtration process, thereby totally eliminating perc emissions. Consequently, this design results in not only making the operation of a dry cleaning machine a non health hazard, but also yields significant cost savings and cleaner clothes. The cost reductions are two-fold: First any cost associated with the installation, use and disposal of filters will be eliminated, and second, perc usage is reduced by up to 90% of current levels. The clothes are also cleaner because the filter, after the first few uses, actually serves as a source of contamination of the clean perc. Conventional wisdom has the filters removing dirt, etc., from the perc. This is briefly true (i.e., for a few weeks), but for the next month and a half until the filter is changed, the filter is likely dirtier than the solvent. This is because much of the solvent is frequently cleansed during normal operations—either by evaporation after each use or periodic distillation. Therefore, given the evaporation and distillation processes and the fact that the filters are changed infrequently, the perc or other solvent is usually cleaner when it enters the filters than when it leaves them.

BRIEF DESCRIPTION OF THE DRAWINGS

In the attached Figures, shading of the lines is an indication of the perc quality carried in the pipes, i.e. white (clean per) and dark gray (perc in need of cleansing).

DETAILED DESCRIPTION OF THE INVENTION

With conventional dry cleaning processes, the articles to be cleaned are placed in a perforated drum of a machine for dry cleaning. Once the articles to be cleaned are placed inside the machine, the drum is filled with solvent and detergents, and turned until all the dirt is removed from the articles.

In reality, the dry cleaning process is carried out via humidity, i.e., instead of washing the articles with soap and water or with detergents, they are treated within a chamber with easily volatile solvents which contain water in suspension via the detergent, but which do not wet clothing or textile articles. Typical solvents include trichloroethane, trichlorotrifluorethane, carbon tetrachloride, trichloroethylene, tetrachloro-ethylene and naptha in addition to perc. These dissolve and remove dirt without any need of wetting and scrubbing the weave.

Once the cleaning process has taken place, the clothing articles or textiles must spin at a high speed in order to extract excess solvent, followed by drying of the articles which is carried out by having them turn slowly in hot air. The solvent is then filtered to remove the solid dirt particles, followed by a distillation process, which removes the soluble contaminants, leaving the solvent ready for the next dry cleaning process.

Figure 1:
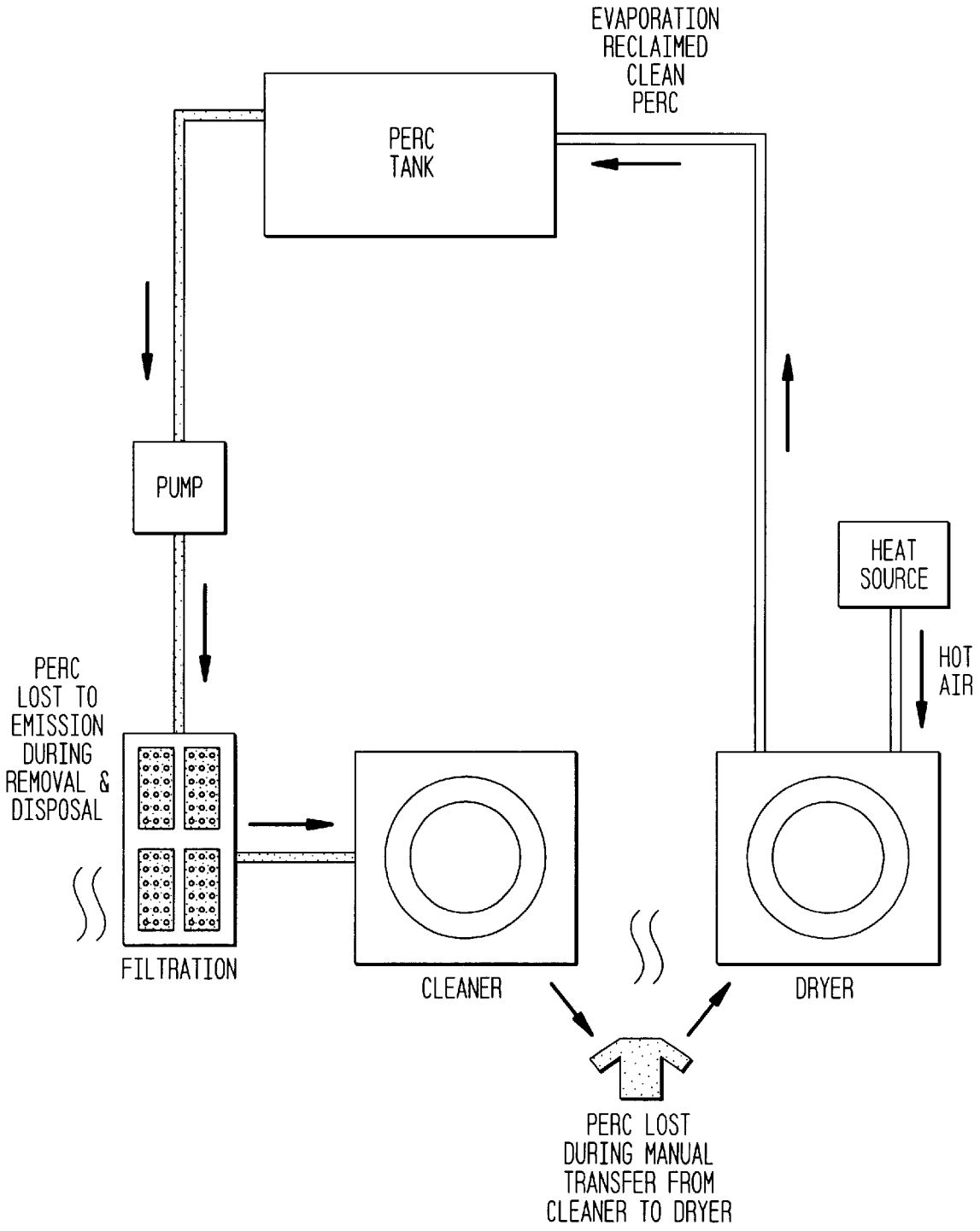
FIG. 1 (PRIOR ART)
FIG. 1: machine setup commonly referred to as "Wet & Dry" in dry cleaning parlance.
Figure 2:
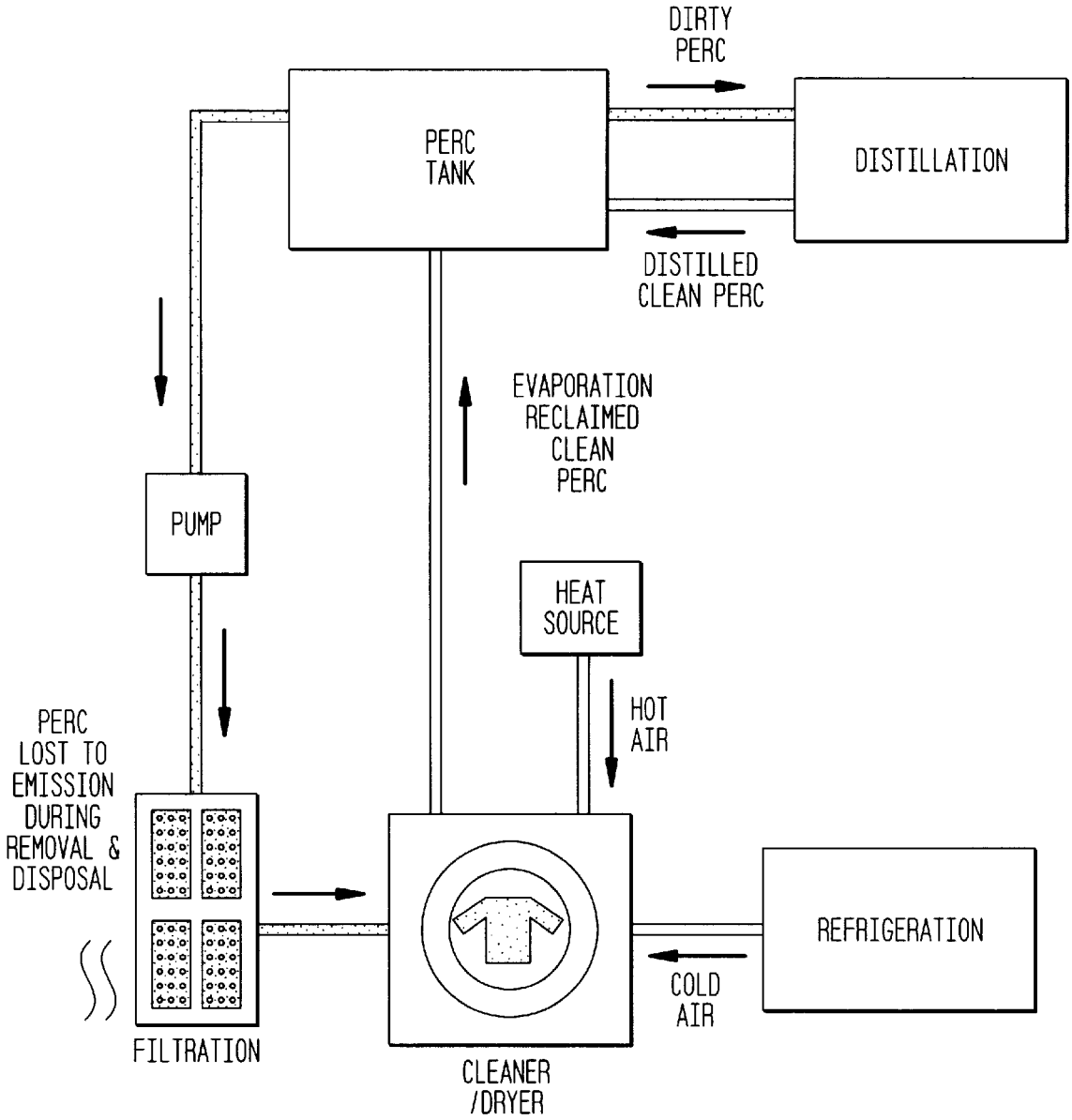
FIG. 2 (PRIOR ART)
FIG. 2: block diagram of "Dry & Dry" dry cleaning machine. This machine is the most advanced machine currently available.

The principal object of the present invention is to eliminate the need for the filtration unit shown in FIGS. 1 and 2. This is accomplished most simply by the apparatus depicted in FIG. 3, wherein the pump and filtration unit are replaced by a continuous piece of pipe or tubing 20 flowing to cleaner/dryer 10. Since evaporated solvent is clean and distilled solvent is clean, it stands to reason that the filtration units of previously available machines serves little useful purpose and can be actually detrimental to the cleaning process. As clean solvent is forced through a dirty filter it necessarily picks up contaminants.

Figure 4:
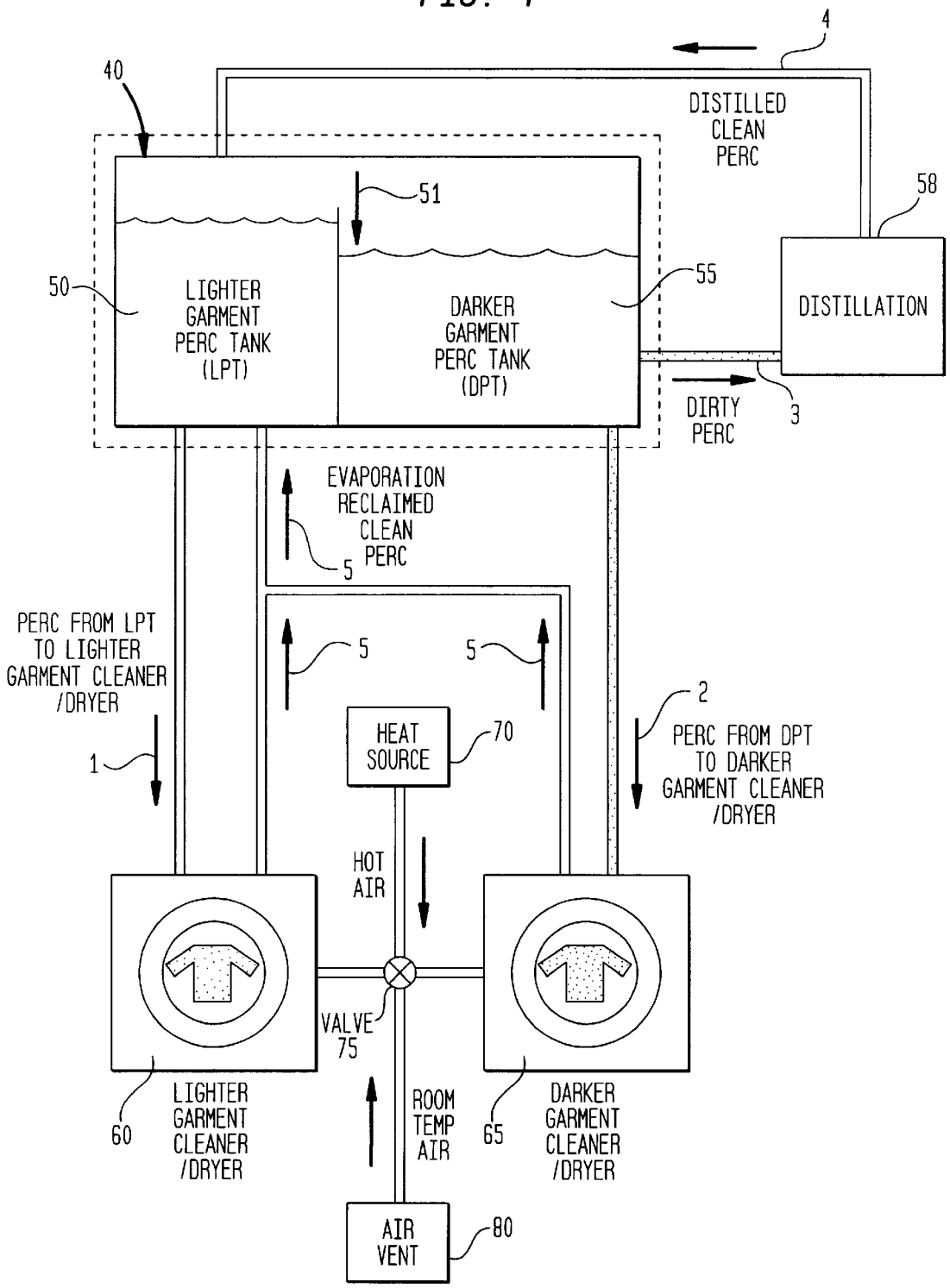
FIG. 4: block diagram of an alternative embodiment of the present invention.

In an alternative embodiment, separate perc tanks 50 and 55 and cleaner/dryers 60 and 65 may be dedicated to lighter and darker garments (see FIG. 4). Two tanks would be designed in a manner that the cleansed perc would flow into the LPT 50 (lighter garment perc tank) and the run off from the LPT would flow into the DPT 55 (darker garment perc tank). Because the flow between LPT 50 and DPT 55 is controlled by runoffs (indicated by reference numeral 51), no pumps are used. The distillation unit 58 would be the sole perc cleansing apparatus necessary. All this would operate in a seamless manner and without the aid of a pump since the perc flows between LPT 50 and DPT 55 is regulated only by the runoff 51 from LPT 50, completely transparent to the machine operator.

This configuration has the further advantage of providing a way of cleaning (through distillation 58) only the dirty solvent. Presently, whenever a distillation process is performed all solvent is distilled. This is obviously wasteful. With the apparatus of FIG. 4, only the perc 3 (or other solvent) from the DPT 55—the only perc that is not clean—is distilled through the distillation unit 58.

This configuration is not the same as using two dry & dry machines individually dedicated to lighter and darker garments, because that scenario presents prohibitive cost of an extra machine in addition to all the problems associated with the use of filters would still persist.

Even if the filters were not environmentally damaging, they are not good cleansing agents. Their cleansing performance is not consistent throughout their lifetime. It ranges from good when the filter is new, to unsatisfactory when the filtering elements inside the filter become saturated with impurities. Toward the end of a filter's lifetime, clean perc pumped through the old filter leaves the filtration unit dirtier than it entered. It is intuitive that a greater amount of energy must be spent by the pump in forcing the perc through a dirty filter than a clean one. This scenario actually occurs in current dry & dry machines because perc is cleansed by the distillation unit on a much more frequent basis than the filters are changed. It is a common practice among the dry clean industry to clean lighter garments for their best customers immediately after new filters are installed. Despite all these facts, perc is still pumped through the filtration unit before every single load with the dry & dry machines.

The rationale for the filters is to remove the dirt left behind in the perc solvent by the originally dirty garments. Lighter garments, by the nature of their color scheme, can retain less dirt before they appear in need of cleaning and the reverse is true for darker garments. As a result, lighter garments leave behind a significantly less amount of dirt in the perc solvent than darker garments. Accordingly, lighter garments have a more stringent requirement on perc quality compared to darker garments for proper cleaning result. Nevertheless, all clothes, irrespective of color, are cleaned using the perc solvent sourced from the same perc tank in the dry & dry machines. Consequently, dry & dry machines have inconsistent cleaning result.

Figure 3:
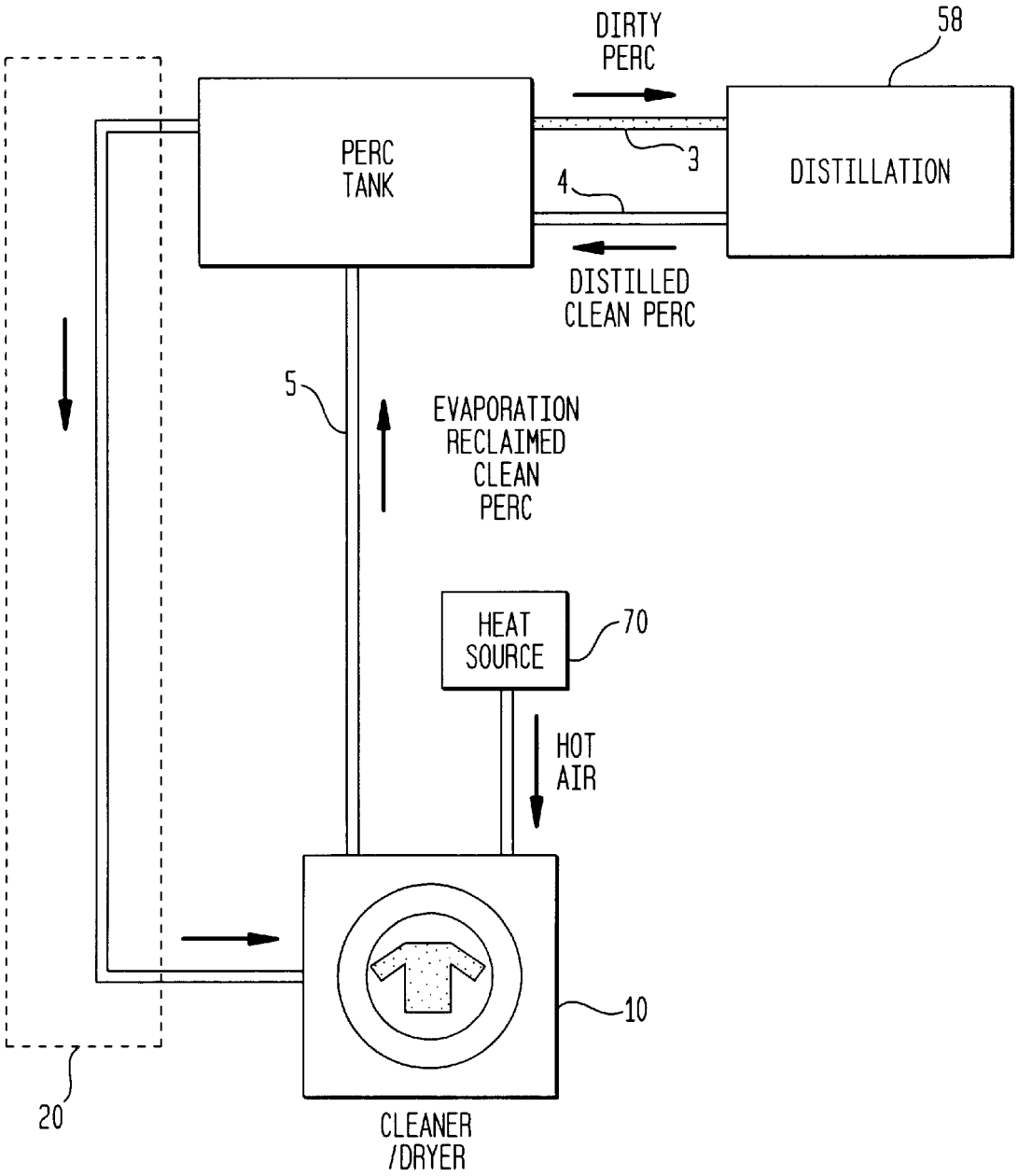
FIG. 3: block diagram of the improved dry cleaning machine of the present invention.

This is the root of the flaw with the dry & dry machine design, which may be improved by replacement with the design of FIG. 3 or modification with the design of FIG. 4. Currently, a single perc tank is trying to maintain perc quality for two groups of garments with different perc quality requirements and different dirt shedding properties. If the perc solvent for lighter and darker garments is held in separate tanks then the disparate perc quality can be maintained. This proposition does not involve the cost of a separate tank. As shown in FIG. 4, a single perc tank 40 may be partitioned to prevent the contents of LPT 50 and DPT 55 from mixing. The LPT 50 needs replenishing sources of clean perc. The distilled perc 4 from the distillation unit 4 and evaporation captured perc 5 from the dryers 60 and 65 can serve as clean perc sources. The perc tank 40 can be partitioned according to anticipated volume requirements of the LPT 50 can and any runoff 51 would overflow into to the DPT 55 with only gravity's aid. The quality of this runoff perc 51 surpasses the perc quality requirements for intended darker garments. When the perc quality in the DPT 55 deteriorates below acceptable level, then the content of the DPT 55 can be cleansed by the distillation unit 58. The resulting cleansed perc 4 from the distillation unit 58 would flow into the LPT 50 and the subsequent runoff 51 would refill the DPT 55 and the whole process can repeat. My zero emission machine design preferably also includes an agitator 95 (FIG. 5), a small propeller-like device, at the bottom of the LPT 58 and DPT 55. The agitators 95 would stir the content of their respective perc tanks and in effect prevent sediment build up. The agitators 95 would operate during the perc transport states of their respective perc tanks and result in optimal garment cleaning performance. This design requires two cleaner/dryer units 60 and 65, one for the lighter garments (60) and the other for the darker garments (65). The improvement in consistent cleaning performance would alone merit the cost of an additional cleaner/dryer unit. However, the savings from eliminating the filtration unit and the pump plus the savings from lower perc usage would more than offset the cost of as extra cleaner/dryer unit. Another anticipated advantage of the design of FIG. 4 is the ability to operate the two cleaner/dryer units 60 and 65 in unison. The current practice in dry cleaning industry is to initially separate the daily workload into groups of light and dark garments before the work can begin and then clean each load in succession. In my design the two cleaners 60 and 65 can operate concurrently, effectively reducing the work time in half. A single heat source 70, commonly a boiler, can dry the clothes of both light and dark garment cleaners, and this can be achieved with a simple valving solution (indicated by reference numeral 75). Most of the heat generated for the dryer is lost to the surroundings rather than used to evaporate perc from clothes. Because the proposed design runs for half the time compared to machines currently available, there is a significant amount of anticipated savings in energy cost for the heat source. This is intuitive since the same amount of heat would dry a greater quantity of clothes.

As shown in the drawings, the most apparent elements missing from the disclosed zero emission machine compared to dry & dry machine are the filtration unit, the filter pump, and optionally the refrigeration unit. However, a refrigeration unit (as shown in FIG. 2) may be substituted for or used in conjunction with air vent 80.

The operation of the zero emission machine of FIG. 3 is essentially unchanged from current equipment as far as the operator is concerned—the filtration system has just been removed. In the alternative embodiment of FIG. 4, operation is as follows: Garments in need of cleaning would be loaded into their respective cleaner/dryer unit 60 and 65 according to color scheme. When the cleaning cycle begins, perc from pipe 1 in FIG. 5 empties into the lighter garment cleaner/dryer 60 and likewise from pipe 2 into the darker garment cleaner/dryer 65. The unused portion of perc captured during the spin cycle are returned to LPT 50 and DPT 55 using the same respective pipes 1 and 2. The perc captured during the dry cycle, cleansed through evaporation, from both lighter and darker cleaner/dryer (60 and 65, respectively) is combined (See FIG. 4) and this clean perc replenishes LPT 50 through pipe 5 in FIG. 5. While LPT 50 is being replenished, the LPT agitator 95 is activated to stir the sediments and the runoff 51 goes to fill the DPT 55. As the dry cycle is coming to an end, the clothes are devoid of any traces of perc, the air vent valve 75 can be activated to cool the hot garment to minimize the wrinkling. This cycle is repeated until the perc in DPT 55 is below the necessary perc quality for darker garments. I want to emphasize both cleaner/dryer 60 and 65 do not always have to operate in unison. It is a simple matter of control units and valving so each cleaner/dryer units can operated in stand-alone mode. The unison mode is implemented as a time and cost saving procedure.

Figure 5:
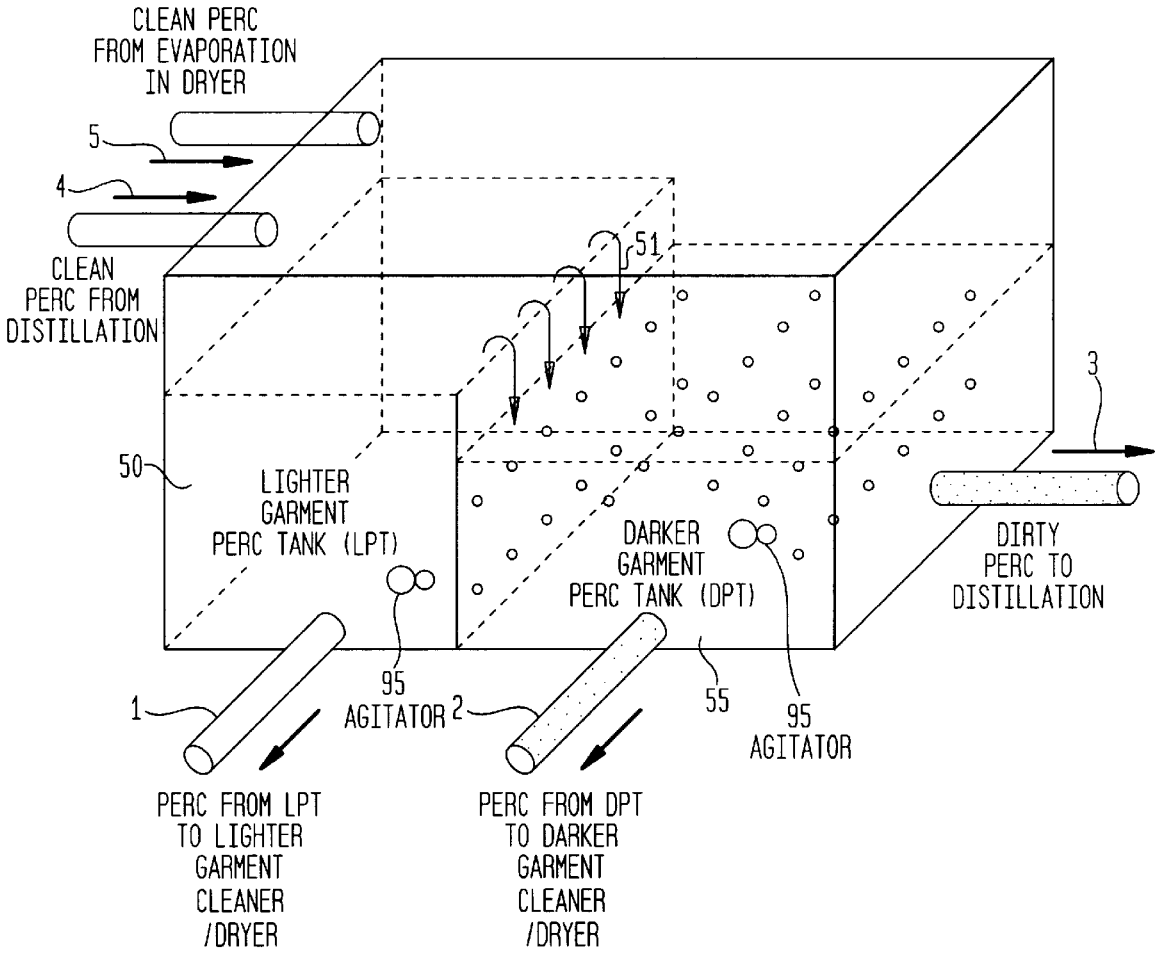
FIG. 5: 3-D drawing for the LPT (light garment perc tank) and DPT (dark garment perc tank) in FIG. 4.
Figure 6:
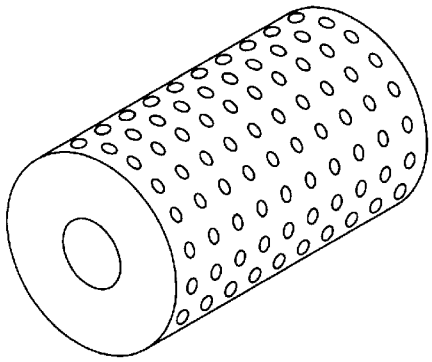
FIG. 6 (PRIOR ART)
FIG. 6: a common filter used in current dry cleaning machines. Source: Owner's manual of Hoffman dry cleaning machine, model 2010 (1992).

When the perc in DPT 55 needs cleansing, the content of DPT 55 will empty out through pipe 3 in FIG. 5 into the distillation unit 58 in FIG. 4. While DPT is being emptied, the DPT 55 agitator 95 is activated to stir the sediments in DPT 55. In this manner, sediments are passed along initially from the LPT 50 to DPT 55 and finally to the distillation unit 58 where it can safely remove as distillation residue. This will prevent any possible build up and result in optimal garment cleaning performance. The clean distilled perc from the distillation unit in FIG. 4 replenishes the LPT through pipe 4 in FIG. 5 and the LPT agitator 95 is activated and the runoff 51 overflows to fill the DPT 55. This process can consistently maintain perc quality for the different type of garments without any regulators, pumps, or other quality control mechanism. The only aid comes from gravity which performs the runoff and consumes no energy.

It will be immediately apparent to those of skill in the art that numerous other modifications and advantages are possible through the use of the apparatus and method of the present invention. For example, the segmented solvent tank 40 depicted in FIG. 4 could be used in the dry cleaning machine depicted in FIG. 3. Likewise, the single cleaner/dryer unit 10 depicted in FIG. 3 could be substituted for the dual cleaner/dryer apparatus 60 and 65 shown in FIG. 4. All such modifications are within the intended scope of the appended claims.

What is claimed is:

1. An improved dry cleaning system comprising:

a cleaner/dryer unit;

a heating unit connected to said cleaner/dryer unit;

two solvent tanks separately connected to said cleaner/dryer unit, whereby a first solvent tank is used to maintain clean solvent, and a second solvent tank is used to maintain less clean solvent; and a distillation unit connected to said second solvent tank such that the less clean solvent may be periodically transported to and distilled in said distillation unit and thereafter be returned to said first solvent tank free from contaminants, whereby said first solvent tank and said second solvent tank are connected such that upon the solvent level of said first solvent tank reaching a predetermined level, additional solvent will flow to said second tank by gravity.

2. A dry cleaning system according to claim 1 wherein said first solvent tank and said second solvent tank include agitator means to disperse sediment.

3. A dry cleaning machine according to claim 1 further including a cooling unit connected to said cleaner/dryer for cooling clothing at the conclusion of said dry cleaning operation.

4. A dry cleaning machine according to claim 3 wherein said cooling unit is a refrigeration unit.

5. A dry cleaning machine according to claim 3 wherein said cooling unit is an air vent.

6. An improved dry cleaning system comprising:

a first cleaner/dryer unit;

a second cleaner/dryer unit;

a heating unit connected to said first cleaner/dryer unit and said second cleaner/dryer unit;

a first solvent tank used to maintain clean solvent connected to said first cleaner/dryer unit;

a second solvent tank used to maintain less clean solvent connected to said second cleaner/dryer unit;

a distillation unit connected to said second solvent tank such that the less clean solvent may be periodically transported to and distilled in said distillation unit and thereafter be returned to said first solvent tank free from contaminants, whereby said first solvent tank and said second solvent tank are connected such that upon the solvent level of said first solvent tank reaching a predetermined level, additional solvent will flow to said second tank by gravity.

7. A dry cleaning system according to claim 6 wherein said first solvent tank and said second solvent tank include agitator means to disperse sediment.

8. A dry cleaning machine according to claim 6 further including a cooling unit connected to said cleaner/dryer for cooling clothing at the conclusion of said dry cleaning operation.

9. A dry cleaning machine according to claim 8 wherein said cooling unit is a refrigeration unit.

10. A dry cleaning machine according to claim 8 wherein said cooling unit is an air vent.

11. An improved dry cleaning system comprising:

a cleaner/dryer unit;

a heating unit connected to said cleaner/dryer unit;

a segmented solvent tank, having a first segment used to maintain clean solvent, and a second segment used to maintain less clean solvent;

whereby each segment is separately connected to said cleaner/dryer unit; and a distillation unit connected to said second segment such that the less clean solvent may be periodically transported to and distilled in said distillation unit and thereafter be returned to said first segment free from contaminants, whereby said first segment and said second segment are connected such that upon the solvent level of said first segment reaching a predetermined level, additional solvent will flow to said second segment by gravity.

12. A dry cleaning system according to claim 11 wherein said first solvent tank and said second solvent tank include agitator means to disperse sediment.

13. A dry cleaning machine according to claim 11 further including a cooling unit connected to said cleaner/dryer for cooling clothing at the conclusion of said dry cleaning operation.

14. A dry cleaning machine according to claim 13 wherein said cooling unit is a refrigeration unit.

15. A dry cleaning machine according to claim 13 wherein said cooling unit is an air vent.

16. An improved dry cleaning system comprising:

a first cleaner/dryer unit;

a second cleaner/dryer unit;

a heating unit connected to said first cleaner/dryer unit and said second cleaner/dryer unit;

a solvent tank having a first segment used to maintain clean solvent connected to said first cleaner/dryer unit and a second segment used to maintain less clean solvent connected to said second cleaner/dryer unit;

a distillation unit connected to said second segment such that the less clean solvent may be periodically transported to and distilled in said distillation unit and thereafter be returned to said first segment free from contaminants, whereby said first segment and said second segment are connected such that upon the solvent level of said first segment reaching a predetermined level, additional solvent will flow to said second segment by gravity.

17. A dry cleaning system according to claim 16 wherein said first solvent tank and said second solvent tank include agitator means to disperse sediment.

18. A dry cleaning machine according to claim 16 further including a cooling unit connected to said cleaner/dryer for cooling clothing at the conclusion of said dry cleaning operation.

19. A dry cleaning machine according to claim 18 wherein said cooling unit is a refrigeration unit.

20. A dry cleaning machine according to claim 18 wherein said cooling unit is an air vent.

21. A dry cleaning process comprising the steps of:

placing the articles to be cleaned in a cleaner/dryer unit;

allowing a pre-determined amount of solvent to flow into said cleaner/dryer unit;

spinning said cleaner/dryer unit to extract excess solvent;

heating said cleaner/dryer unit such that the articles are dried and the solvent evaporates;

containing said evaporated solvent in a segmented tank, such that one segment receives clean solvent when light colored articles are cleaned, and the other segment receives less clean solvent when darker colored articles are cleaned;

distilling the less clean solvent when the extent of contamination reaches a predetermined level;

returning the contaminate free solvent from to the tank segment containing the clean solvent; and refilling the tank segment containing the less clean solvent with overflow from the tank containing the clean solvent, whereby the process can be repeated.

* * * * *